US005280716A

United States Patent [19]

Ryan et al.

[11] Patent Number: 5,280,716

[45] Date of Patent: Jan. 25, 1994

[54] CRIMPING TOOL

[75] Inventors: Dale R. Ryan, Harrisburg; Steven T. Merkt, New Cumberland; David B. Weaver, Landisburg; Richard L. Schaeffer, Carlisle, all of Pa.

[73] Assignee: The Whitaker Corporation, Wilmington, Del.

[21] Appl. No.: 976,129

[22] Filed: Nov. 13, 1992

[51] Int. Cl.[5] ..... H01R 43/042

[52] U.S. Cl. ..... 72/410; 29/751; 81/313; 81/374; 81/383

[58] Field of Search ..... 72/410, 409; 29/751; 81/374, 381, 383, 313

[56] References Cited

U.S. PATENT DOCUMENTS

| | | | |
|---|---|---|---|
| 2,445,480 | 7/1948 | Gantt | 81/78 |
| 3,285,107 | 11/1966 | Kasper | 81/368 |
| 3,360,068 | 12/1971 | Floyd | 72/410 |
| 4,283,933 | 8/1981 | Wiener | 72/409 |
| 4,561,282 | 12/1985 | Hadden | 72/410 |
| 4,633,558 | 1/1987 | Spaulding | 29/229 |
| 4,794,780 | 1/1989 | Battenfeld | 72/410 |
| 4,829,805 | 5/1989 | Koehn | 72/410 |

FOREIGN PATENT DOCUMENTS

| | | | |
|---|---|---|---|
| 2902344 | 8/1980 | Fed. Rep. of Germany | 29/751 |
| 1522144 | 8/1978 | United Kingdom . | |

*Primary Examiner*—Daniel C. Crane

*Attorney, Agent, or Firm*—Robert J. Kapalka

[57] ABSTRACT

A tool for crimping a terminal to an end of an electrical conductor has a movable fulcrum which reduces hand force required to operate the crimping tool. The tool includes main body having a handle end and a first jaw disposed remote from the handle end. A second jaw is pivotally connected to the main body between the handle end and the first jaw. The a second jaw cooperates with the first jaw to perform the crimping as the second jaw is pivoted toward the first jaw. A movable handle is operably connected to the second jaw to pivot the second jaw toward the first jaw. A driver link has a first end pivotally connected to the main body, and a second end of the driver link has a slidable connection with the movable handle. The slidable connection includes a pivot pin which is slidable in a slot defined in the movable handle. As the movable handle is operated to pivot the second jaw toward the first jaw, the fulcrum is displaced relative to the movable handle between at least a first position and a second position, thereby modifying a distance between the fulcrum and the connection of the movable handle with the second jaw.

18 Claims, 5 Drawing Sheets 15
33
34
28
46
25
54
58
52
36
44
10
68
22
18
64
40
20
48
F
42
21
62
12

15
33
34
28
46
25
54
58
44
36
52
10
68
90°
64
22
18
40
48
20
F
21
42
62
12

CRIMPING TOOL

BACKGROUND OF THE INVENTION

1. Field of the Invention

The invention relates to the field of tools for crimping a terminal to an end of an electrical conductor, and more particularly, to a crimping tool having a handle pivotable about a displaceable fulcrum so as to reduce the force required to operate the tool through a complete crimping cycle.

2. Prior Art

Terminals are generally attached to ends of electrical conductors by soldering or crimping. Terminals suitable for crimping have a channel or barrel adapted to receive an end of a wire or cable conductor therein. During crimping, the end of the conductor having the terminal thereon is disposed between a pair of opposed members which are relatively movable to tightly squeeze the workpiece between the members. The channel or barrel portion of the terminal is deformed by the tight squeezing so as to securely grip the conductor and resist separation therefrom.

Hand tools for crimping a terminal to an end of an electrical conductor are well known. Such tools generally include a pair of relatively movable jaw members which cooperate to crimp the terminal to the conductor upon actuation of a handle mechanism. In order to as sure that each crimped terminal will maintain dependable electrical contact with its associated conductor and be secure against separation therefrom, it is desirable to deform the terminal during crimping so as to achieve a certain maximum crimp height, such height depending upon the size and type of terminal and conductor being crimped. Rather than measure directly the crimp height of terminals after crimping, it is known to provide a crimping tool with a mechanism that assures that the crimping jaw members will converge to within at least a predetermined distance from each other, thus assuring that the resulting crimp height will be no greater than the desired maximum. The mechanism is engaged upon initiation of a crimping operation and prevents retraction of the jaw members away from each other until the predetermined minimum separation of the jaw members is achieved.

A problem with tools having the mechanism which prevents premature retraction of the jaws is that the hand force which must be applied in actuating the handle mechanism increases steeply during a crimping operation as the workpiece is squeezed and deformed between the jaws. The required hand force may become so high that completion of the crimping operation becomes extremely difficult or impossible for some operators. At the very least, the required hand force is usually great enough to cause muscle strain and hand fatigue for the operator performing numerous crimping operations. Muscle strain and hand fatigue can be a problem even for the operator of a hand crimping tool that does not have the retraction prevention mechanism, and long term injurious effects from repetitive crimping operations may be even more severe, e.g., tendinitis and carpal tunnel syndrome. It is desirable to provide a hand crimping tool which consistently produces a secure crimp while reducing the force which must be applied to the handle mechanism during a crimping operation.

SUMMARY OF THE INVENTION

It is an object of the invention to provide a hand operable crimping tool which consistently produces a secure crimp.

It is another object of the invention to provide a hand operable crimping tool which requires less hand force to operate compared with prior crimping tools.

It is a further object of the invention to provide a hand operable crimping tool which produces increasing crimping force on a workpiece during a crimping operation given a constant force applied to the tool handle.

It is still another object of the invention to provide a crimping tool which automatically produces increasing mechanical advantage for an operator of the tool during a crimping operation.

These and other objects are accomplished by a tool comprising a main body portion having a handle end and a first jaw disposed remote from the handle end. A movable jaw member is pivotally connected to the main body portion between the handle end and the first jaw. The movable jaw member defines a second jaw which cooperates with the first jaw to crimp a terminal to an end of an electrical conductor during forward pivoting of the movable jaw member with respect to the main body. A movable handle is operably connected to the movable jaw member to accomplish the forward pivoting. A driver link has a first end pivotally connected to the main body and a second end has a slidable connection with the movable handle. The slidable connection between the movable handle and the second end of the driver link defines a fulcrum for the movable handle. As the movable handle is operated by pivoting on the fulcrum to accomplish the forward pivoting of the movable jaw member, the fulcrum is displaced relative to the movable handle between at least a first position and a second position, thereby modifying a distance between the fulcrum and the connection of the movable handle with the movable jaw. The slidable connection between the movable handle and the second end of the driver link can include a pivot pin acting as the fulcrum which is slidable within a slot defined by the movable handle. An orientation of the slot is selected to automatically urge the pivot pin from the first position to the second position as the movable handle is operated. The tool also includes a ratcheting mechanism connected for pre venting return pivoting of the movable jaw member until a predetermined amount of the forward pivoting has been achieved.

BRIEF DESCRIPTION OF THE DRAWINGS

There are shown in the drawings the embodiments of the invention that are presently preferred. It should be understood, however, that the invention is not limit ed to the precise arrangements and instrumentalities shown in the drawings, wherein.

DETAILED DESCRIPTION OF THE PREFERRED EMBODIMENTS

Figure 1:
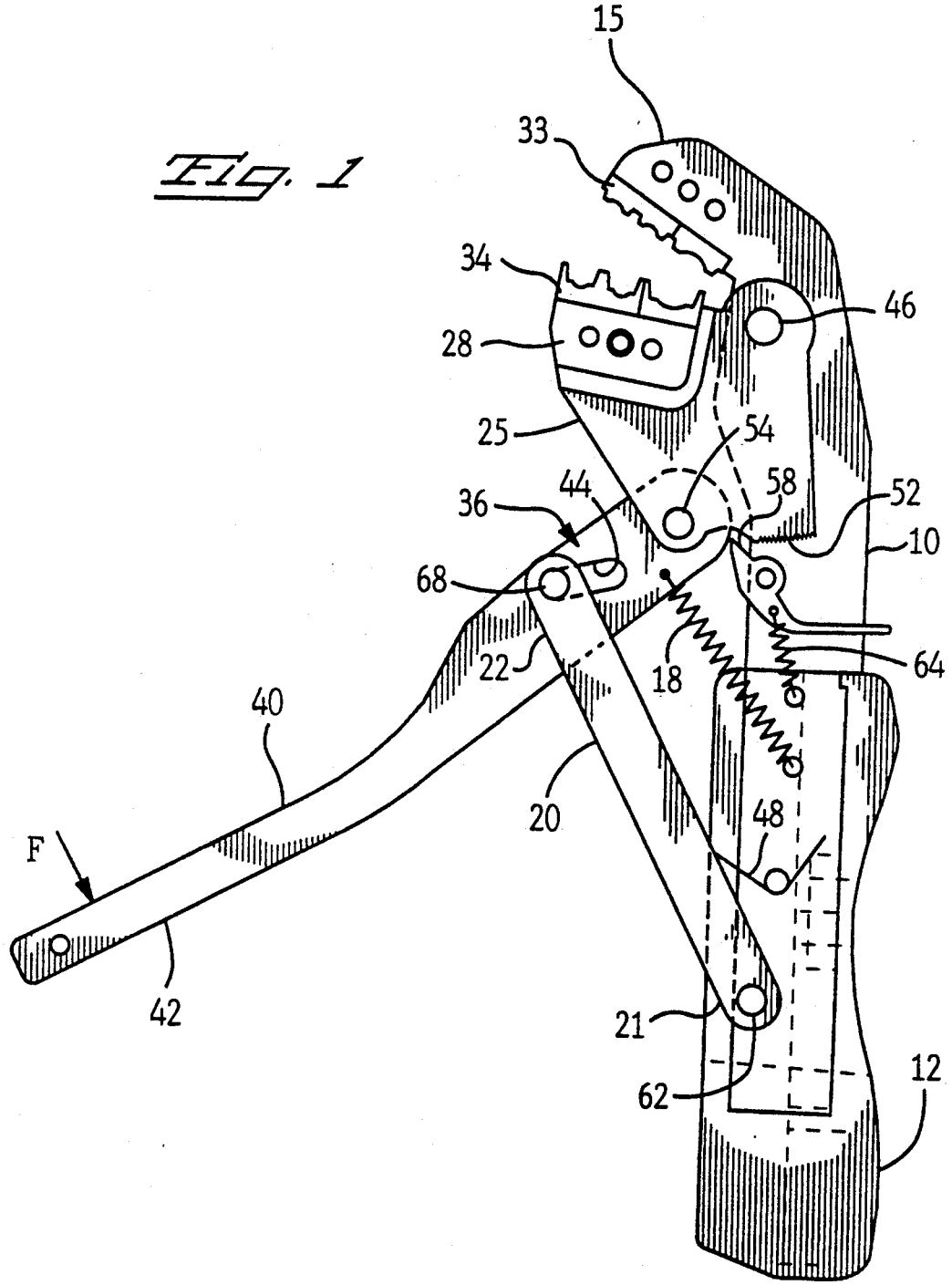
FIG. 1 is a plan view of a crimping tool according to the invention, shown in a fully open position with a fulcrum in a first position.

As shown in FIG. 1, a tool for crimping a terminal to an end of an electrical conductor according to the invention includes a main body or frame 10 having a handle end 12 and a first jaw 15 disposed remote from the handle end. A movable jaw member 25 is pivotally connected such as by pivot pin 46 to the main body 10 between the handle end 12 and the first jaw 15. The movable jaw member 25 is pivotal forwardly (clockwise) and rearwardly (counter-clockwise) with respect to the main body 10. The movable jaw member 25 includes a second jaw 28 which cooperates with the first jaw 15 to perform the crimping during forward pivoting of the movable jaw member. The first and second jaws preferably carry mating halves 33, 34 of a crimping die set, the mating halves being configured to suitably deform a terminal around an end of a conductor to create a secure crimp.

A movable handle 40 is operably connected to the movable jaw member 25 such as by pivot pin 54 to accomplish the forward pivoting of the movable jaw member with respect to the main body. It is, of course, obvious to one skilled in the art that any bounds delineating the second jaw 28 from the movable jaw member 25 are somewhat arbitrary, the second jaw 28 merely being that portion of the movable jaw member 25 most closely associated with the first jaw 15 during a crimping operation. Accordingly, part or all of the movable jaw member 25 could be considered to be the second jaw 28, and the movable handle 40 could be considered to be connected to the second jaw, the net result being that the handle 40 is operable to pivot the second jaw 28 toward the first jaw 15.

A driver link 20 has a first end 21 pivotally connected to the main body 10 such as by pivot pin 62. A second end 22 has a slidable connection 36 with the movable handle 40, the slidable connection defining a fulcrum for the movable handle. Force applied by a user to end 42 of the handle 40 results in pivoting of the handle 40 on the fulcrum. The applied force is transferred to the movable jaw member 25 through the connection defined by the pivot pin 54. In order to perform a crimping operation, the user applies hand force in the direction of arrow F to the handle 40, thereby pivoting the movable jaw member 25 forwardly (clockwise) around the pivot pin 46 to apply pressure to workpiece 66 between the first and second jaws 15, 25, as shown in progressive stages in FIGS. 1–4. The handle 40 pivoting on the fulcrum provides a mechanical advantage to the user so that the force transmitted through the pivot pin 54 is greater than the force applied to the handle 40 by the user. The mechanical advantage is a ratio of the distance from the fulcrum to a point of application of the hand force, divided by the distance from the fulcrum to the connection of the handle 40 with the movable jaw member 25.

Figure 2:
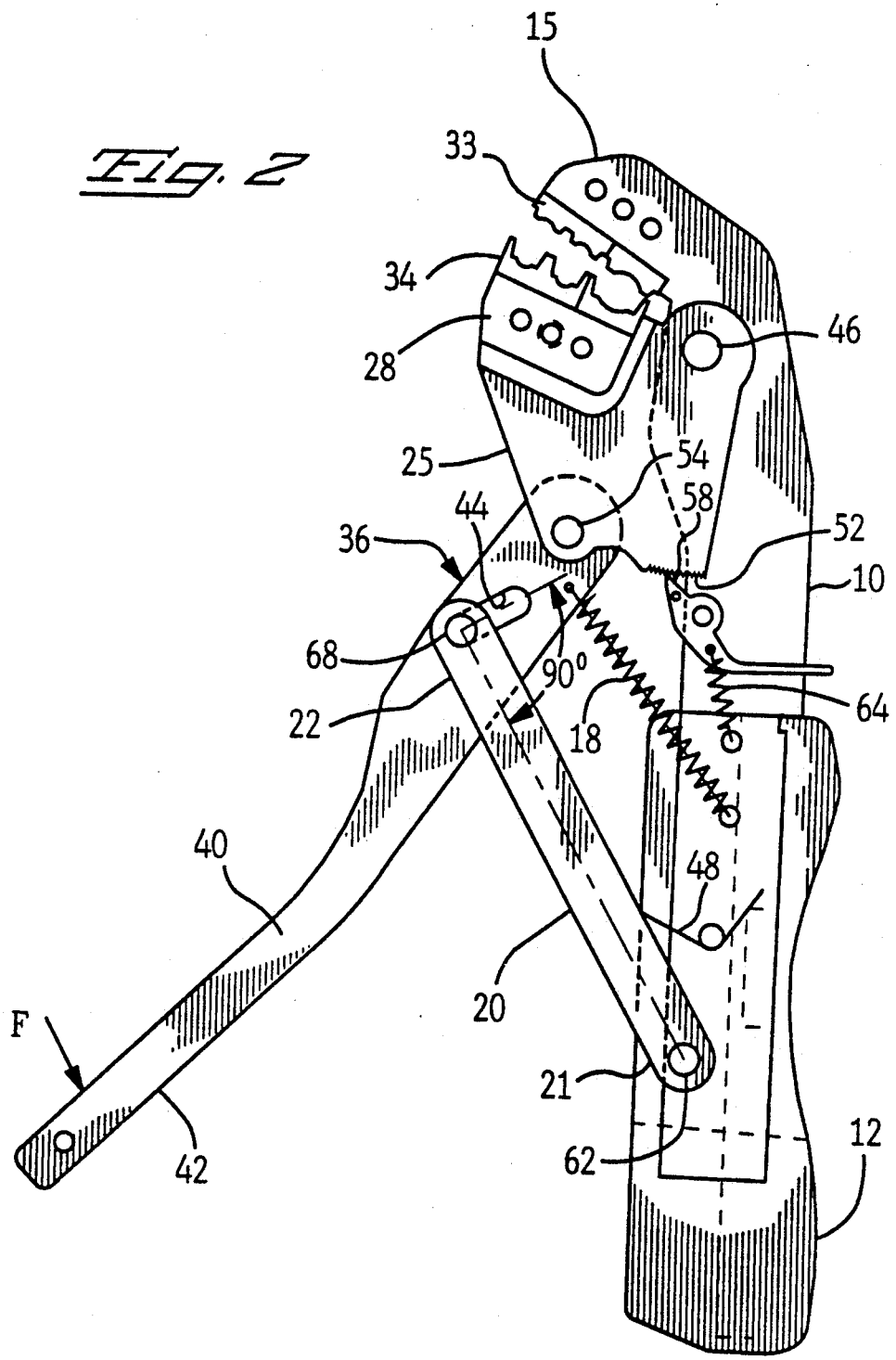
FIG. 2 is a plan view of the crimping tool shown in a partially closed position with the fulcrum in the first position.
Figure 3:
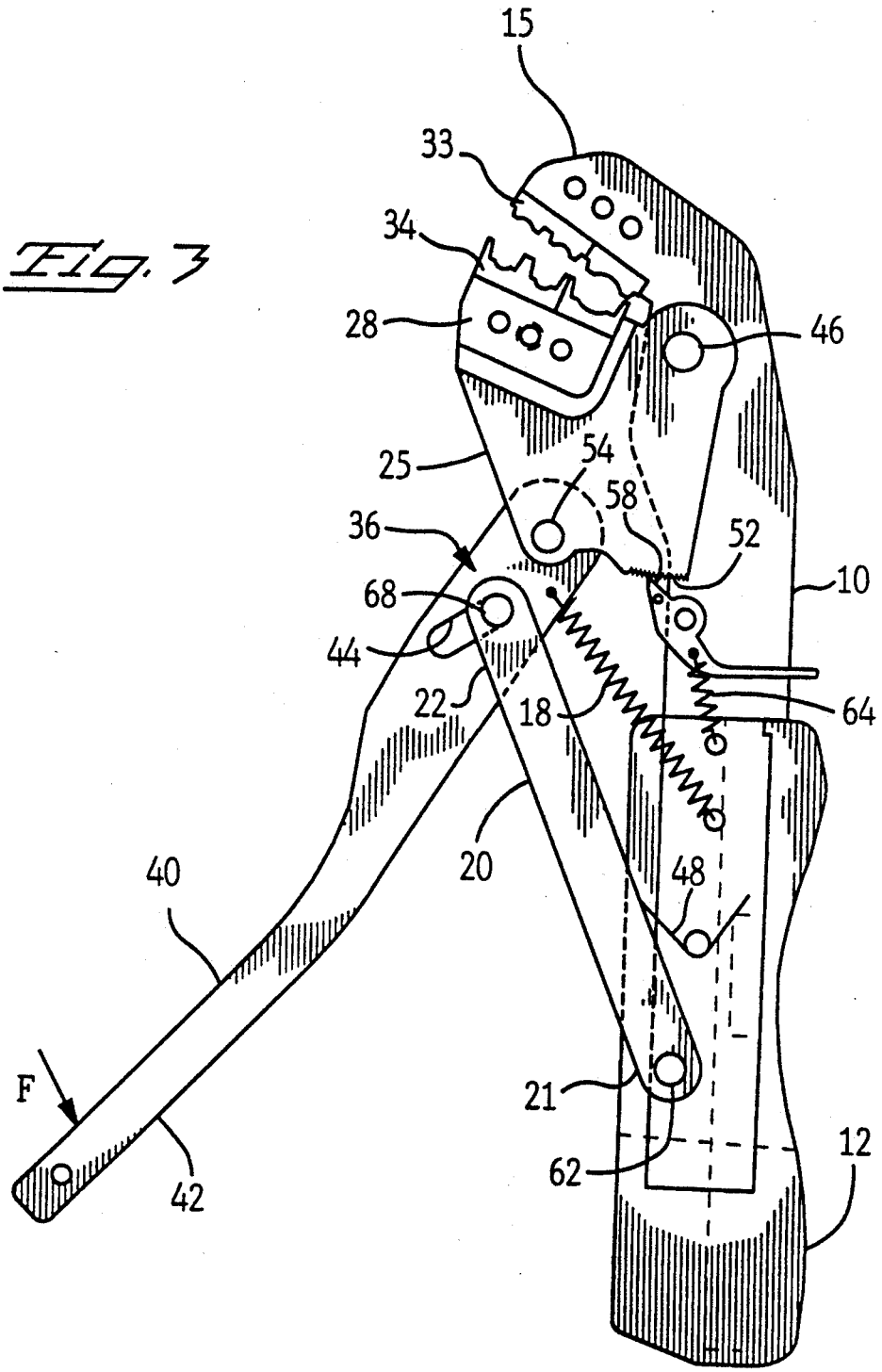
FIG. 3 is a plan view of the crimping tool shown in a further partially closed position with the fulcrum in a second position.
Figure 4:
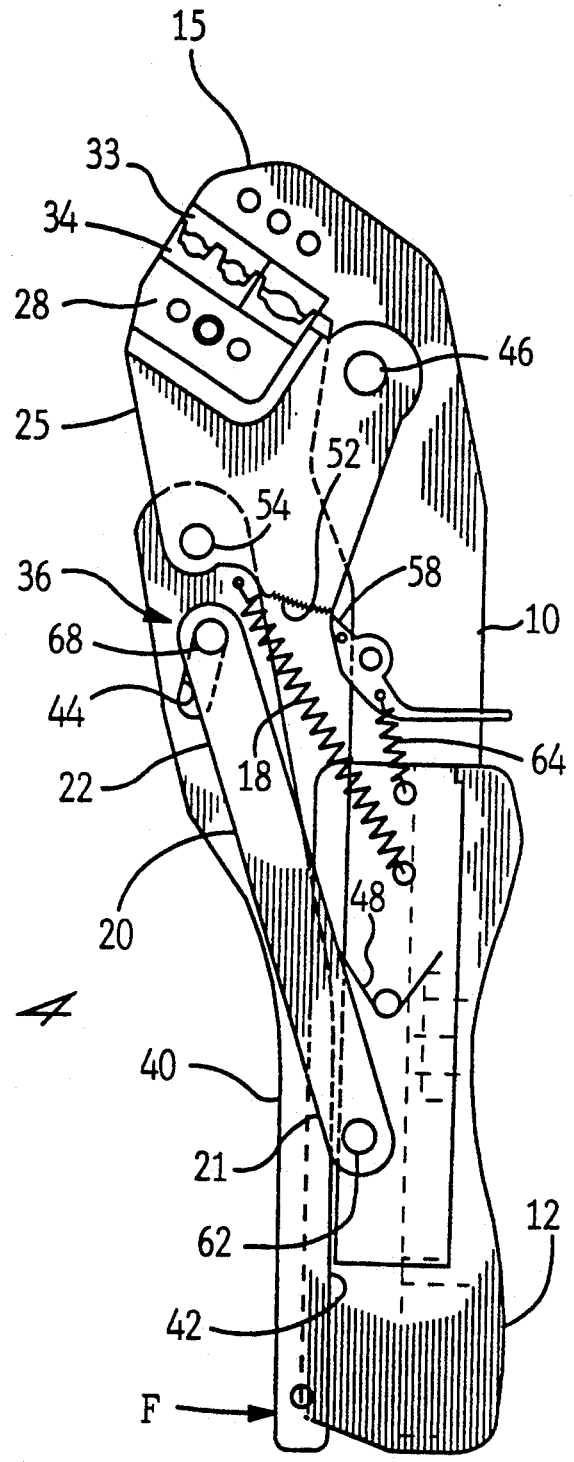
FIG. 4 is a plan view of the crimping tool shown in a fully closed position with the fulcrum in the second position.

The slidable connection 36 enables displacement of the fulcrum relative to the handle 40. As the handle 40 is operated to accomplish the forward pivoting of the movable jaw member and to pivot the second jaw 28 toward the first jaw 15, the fulcrum is automatically displaced relative to the movable handle between at least a first position as shown in FIGS. 1 and 2, and a second position shown as shown in FIGS. 3 and 4. The fulcrum is caused to be displaced by any suitable means for urging the fulcrum from the first position to the second position at some selected time during the crimping operation. The displacement of the fulcrum alters a distance between the fulcrum and the connection of the handle 40 with the movable jaw member 25, thereby changing the mechanical advantage available to assist a user of the crimping tool during a crimping operation. It is preferred that the fulcrum be displaced so as to increase the mechanical advantage for the user after some amount of forward pivoting of the movable jaw member has occurred.

In a preferred embodiment as shown in the Figures, the handle 40 defines a slot 44, and the slidable connection 36 includes a pivot pin 68 acting as the fulcrum which is slidable within the slot. The preferred embodiment automatically displaces the fulcrum so as to increase the mechanical advantage for the user. Referring to FIG. 1, a force applied to the handle 40 in the direction of arrow F results in counterclockwise pivoting of the handle and forward pivoting of the movable jaw member 25. Referring now to FIG. 2, an impending trip of the fulcrum from the first to the second positions exists when an angle defined by the driver link 20 and the slot 44 approaches 90°. When the 90° trip angle is reached as shown in FIG. 2, continued pivoting of the handle 40 drives the pivot pin 68 to the opposite end of the slot 44, i.e., the second position as shown in FIG. 3. The pivot pin will reside in the second position during the final stages of handle rotation until the handle is fully closed as shown in FIG. 4. Opening the handle automatically resets the pivot pin to the first position in a progression that is a mirror image to the handle closing.

It is desired that the pivot pin 68 acting as the fulcrum remain in the first position until the first and second jaws have firmly engaged a workpiece 30 because the first position provides maximum pivoting of the movable jaw member 25 for a given amount of pivoting of the handle 40, and because multiplication of force is not a consideration until deformation of the workpiece 30 is initiated. Once deformation of the workpiece begins, it is desired that the fulcrum be displaced to the second position in order to achieve maximum force multiplication for performing the crimping operation and to lower the force that the user must apply to the handle. The point during handle pivoting at which fulcrum displacement occurs can be selected by selecting an orientation of either or both of the slot 44 and the driver link 20 with respect to the handle 40. Also, the slot 44 can be selected with an irregular configuration such as multiple angles or detents in order to provide multiple positions for the fulcrum during a crimping operation.

As shown in FIGS. 1–4, the crimping tool preferably includes a first biasing member such as spring 18 connected between the main body 10 and the handle 40 for biasing the handle to the open position. A second biasing member such as spring 48 is connected between the main body and the driver link 24 for biasing the fulcrum to the first position when the handle 40 is in the open position.

A crimping tool embodying the displaceable fulcrum feature as hereinabove described is particularly suitable for use in conjunction with a ratchet mechanism that is connected for preventing reverse pivoting of the movable jaw member until a predetermined amount of the forward pivoting has been achieved. The ratchet mechanism may include the movable jaw member 25 defining a plurality of ratchet teeth 52. A pawl 58 attached to the main body 10 successively engages the plurality of ratchet teeth 52 during the forward pivoting of the movable jaw member. The plurality of ratchet teeth 52 are disposed spanning a distance selected to ensure that the movable jaw member cannot be retracted until the second jaw has been pivoted to within a predetermined distance from the first jaw so as to ensure a secure crimp.

Figure 5:
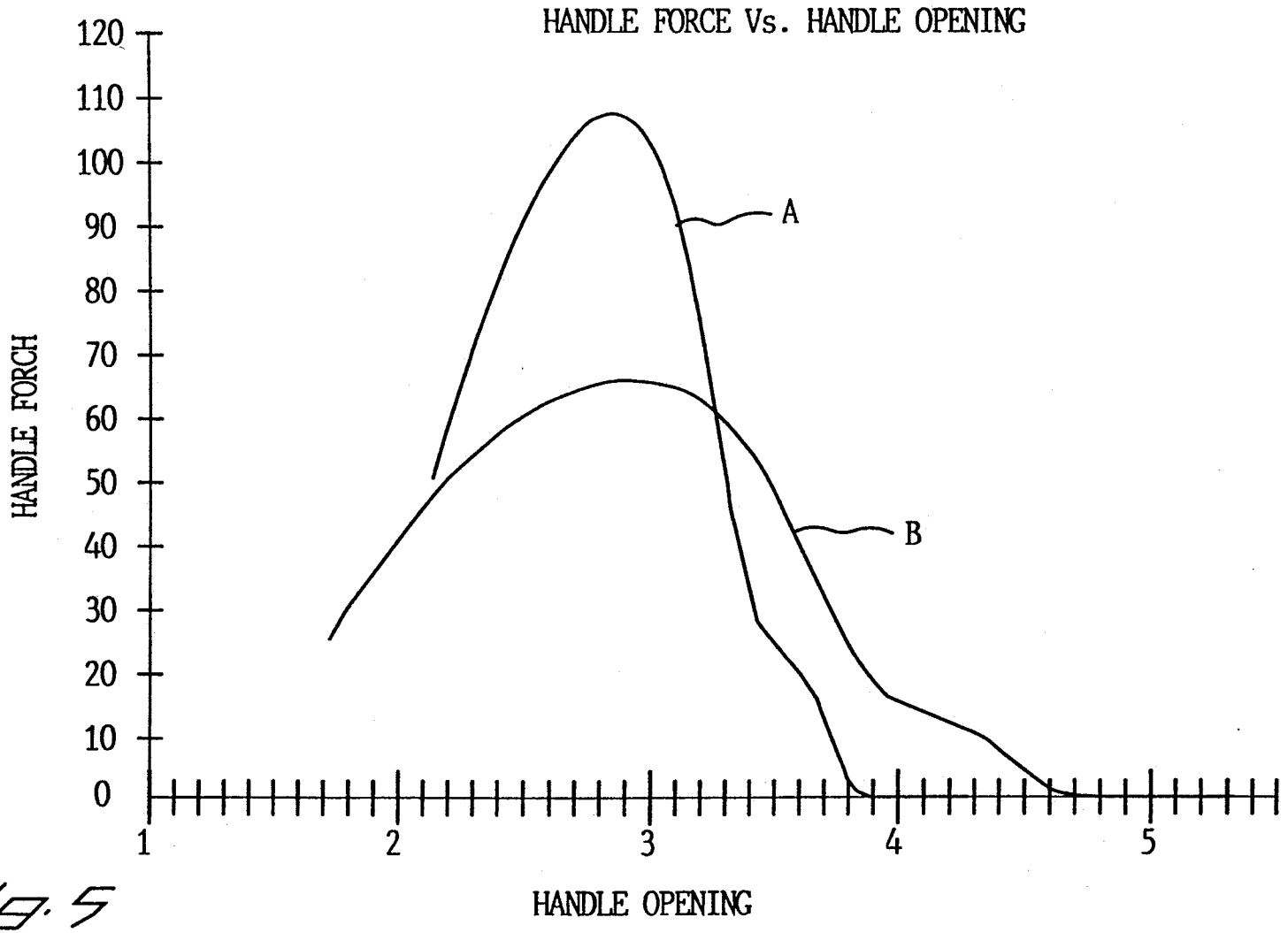
FIG. 5 is a graph of handle force plotted against handle opening for two different crimping tools, wherein "A" represents a standard crimping tool and "B" represents a crimping tool according to the invention.

A crimping tool according to the invention has the advantage that hand force which must be applied to the tool handle to perform a crimping operation is significantly reduced. FIG. 5 is a representative graph of hand force required to perform a crimping operation as a function of handle opening for two different crimping tools. Line A represents a standard crimping tool having a 1.185" long jaw and a 5.6" long handle sold under the name "Pro Crimper" by AMP, Incorporated of Harris burg, PA. Line B represents a crimping tool having a 1.185" long jaw and a 6.2" long handle and having the displaceable fulcrum according to the invention. As displayed in FIG. 5, the plots of handle force follow a progression from the right side of the graph to the left as the handle is closed during the crimping operation. Line B illustrates a substantial reduction in peak handle force required to operate the tool having the displaceable fulcrum. The reduction in peak handle force is on the order of 38%.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A tool for crimping a terminal to an end of an electrical conductor, comprising:

a main body having a handle end and a first jaw disposed remote from the handle end;

a movable jaw member pivotally connected to the main body between the handle end and the first jaw, the movable jaw member defining a second jaw which cooperates with the first jaw to perform the crimping during forward pivoting of the movable jaw member with respect to the main body;

a movable handle operably connected to the movable jaw member to accomplish the forward pivoting;

a driver link having a first end pivotally connected to the main body, and a second end having a slidable connection with the movable handle, the slidable connection defining a fulcrum for the movable handle, wherein as the movable handle is operated to accomplish the forward pivoting of the movable jaw member, the fulcrum is displaced relative to the movable handle between at least a first position and a second position, thereby modifying a distance between the fulcrum and the connection of the movable handle with the movable jaw.

2. The tool according to claim 1, wherein the movable handle defines a slot, and the slidable connection includes a pivot pin acting as the fulcrum which is slidable within the slot.

3. The tool according to claim 2, wherein the slot has an irregular shape.

4. The tool according to claim 1, further comprising a first biasing member connected for biasing the movable handle to an open position.

5. The tool according to claim 1, further comprising a biasing member connected for biasing the fulcrum to the first position.

6. The tool according to claim 4, further comprising a second biasing member connected for biasing the fulcrum to the first position when the movable handle is in the open position.

7. The tool according to claim 1, wherein each of the first and second jaws carries a mating half of a crimping die set.

8. The tool according to claim 1, further comprising a ratchet mechanism connected for preventing reverse pivoting of the movable jaw member until a predetermined amount of the forward pivoting has been achieved.

9. The tool according to claim 8, wherein the ratchet mechanism includes the movable jaw member defining a plurality of ratchet teeth spanning a selected distance, and a pawl attached to the main body successively engages the plurality of ratchet teeth during the forward pivoting of the movable jaw member.

10. A tool for crimping a terminal to an end of an electrical conductor, comprising:

a main body having a handle end and a first jaw disposed remote from the handle end;

a second jaw pivotally connected to the main body between the handle end and the first jaw, the second jaw cooperating with the first jaw to perform the crimping as the second jaw is pivoted toward the first jaw;

a movable handle operably connected to the second jaw to pivot the second jaw toward the first jaw; and, a driver link having a first end pivotally connected to the main body, and a second end having a slidable connection with the movable handle, the slidable connection defining a fulcrum for the movable handle, wherein as the movable handle is operated to pivot the second jaw toward the first jaw, the fulcrum is displaced relative to the movable handle between at least a first position and a second position, such that during operation of the movable handle by a force applied to the movable handle, the fulcrum is urged from the first position to the second position, thereby modifying a distance between the fulcrum and the connection of the movable handle with the second jaw.

11. The tool according to claim 10, wherein the movable handle defines a slot, and the slidable connection includes a pivot pin acting as the fulcrum which is slidable within the slot.

12. The tool according to claim 11, wherein the slot has an irregular shape.

13. The tool according to claim 10, further comprising a first biasing member connected for biasing the movable handle to an open position.

14. The tool according to claim 10, further comprising a biasing member connected for biasing the fulcrum to the first position.

15. The tool according to claim 13, further comprising a second biasing member connected for biasing the fulcrum to the first position when the movable handle is in the open position.

16. The tool according to claim 10, wherein each of the first and second jaws carries a mating half of a crimping die set.

17. The tool according to claim 10, further comprising a ratchet mechanism connected for preventing pivoting of the second jaw away from the first jaw until the second jaw has been pivoted toward the first jaw a predetermined amount.

18. The tool according to claim 10, wherein the ratchet mechanism includes the second jaw defining a plurality of ratchet teeth spanning a selected distance, and a pawl attached to the main body successively engages the plurality of ratchet teeth during the pivoting of the second jaw toward the first jaw.

* * * * *